United States Patent [19]

Castellani et al.

[11] 3,974,677

[45] Aug. 17, 1976

[54] FORGING OF METAL COMPONENTS

[75] Inventors: Claude Castellani, Versailles; Yves Roger, Meudon-la-Foret, both of France

[73] Assignees: Regie Nationale des Usines Renault; Automobiles Peugeot, both of France

[22] Filed: Feb. 3, 1975

[21] Appl. No.: 546,522

[30] Foreign Application Priority Data

Feb. 18, 1974 France ..... 74.05410

[52] U.S. Cl. ..... 72/340; 72/356; 72/377

[51] Int. Cl.[2] ..... B21D 28/00

[58] Field of Search ..... 72/340, 343, 347, 348, 72/349, 352, 356, 358, 377; 64/6, 7

[56] References Cited

UNITED STATES PATENTS

| | | | |
|---|---|---|---|
| 454,073 | 6/1891 | Shea | 72/356 |
| 1,917,502 | 7/1933 | Crawford et al. | 72/340 |
| 3,186,209 | 6/1965 | Friedman | 72/356 X |
| 3,205,680 | 9/1965 | Snyder | 64/7 |
| 3,872,690 | 3/1975 | Salaiczyk | 64/7 X |

*Primary Examiner*—Milton S. Mehr
*Assistant Examiner*—James R. Duzan
*Attorney, Agent, or Firm*—Marn & Jangarathis

[57] ABSTRACT

A petalled tulip-shaped end of a transmission shaft is formed by a cold forging operation consisting of four stages. In a first stage a blank is formed to the approximate size of the component desired, one end of the blank being chamfered eventually to provide a stem. In the second forging operation the petals and stem of the component are roughed out by reverse and direct drawing respectively and a central recess having radial recesses branching off therefrom is formed in the end face of the blank remote from the stem. In the third forging operation the radial recesses and the lateral faces thereof are pushed in the direction of the stem to produce oblique ramps which are extended to provide surplus walls. The fourth and final forging operation involves a cutting off of these surplus walls.

5 Claims, 14 Drawing Figures

FORGING OF METAL COMPONENTS

This invention relates to the forging of a petalled tulip-shaped component and in particular to the production by this technique of the petalled tulip-shaped component of a transmission shaft, the stem of the shaft being connected to the component by welding.

Such component is currently obtained by hot-forging or by forging at a medium temperature.

In the case of hot-forging, the component may be obtained in one-piece (i.e. integral stem or the stem may be later connected thereto, but such hot-forging process has the drawback of necessitating substantial machining of the tulip-shaped component and, depending on the method of construction, also of the stem. In addition, this hot-forging process can be operated only at relatively low speeds.

Forging at a medium temperature is much more accurate than hot-forging, but still requires a considerble amount of machining since the surface conditions obtained are frequently inadequate, especially on inclined parts, and also the operational speeds are also low.

The present invention obviates or mitigates these drawbacks and its particular purpose is to provide a method of producing the petalled tulip-shaped component without any or only very little internal and external maching requirement by an appropriate cold-forging cycle.

According to the present invention there is provided a method for the production of a petalled component by cold-forging and comprising the steps of:

a. producing, during a first forging operation, a blank which has dimensions corresponding approximately to those of the petalled component to be obtained and which has a peripheral chamfer from which will be produced a stem;

b. roughing out, during a second forging operation, petals and the stem by reverse and direct drawing respectively, and producing in the end face of the blank a recess centrally of the petals and extending by radial recesses to the periphery of said end face;

c. pushing, during a third forging operation, the base and lower end of the lateral faces of each radial recess in the direction of the stem to produce a lateral surface or ramp at the side adjacent the axis of the component, which is oblique with respect to said axis, and defines each radial recess of said component and is extended on the opposite side to said axis by a surface constituted by a surplus wall and d. cutting of, during a forth forging operation, said surplus wall.

By means of this method, a component is obtained requiring very little machining if any and at very high speeds on a horizontal or vertical, mechanical or hydraulic multi-station press.

An embodiment of the present invention will now be described, by way of example, with reference to the accompanying drawings, in which.

Figure 5:
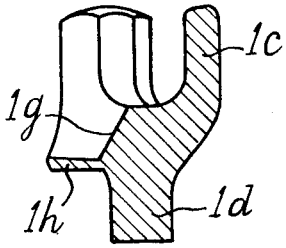
FIG. 5 shows, in axial section, the part obtained after the third forging operation.
Figure 5A:
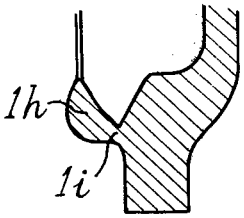
Figure 6:
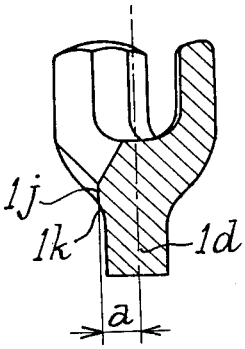
Figure 7:
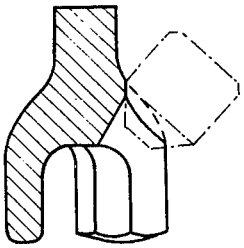
Figure 8:
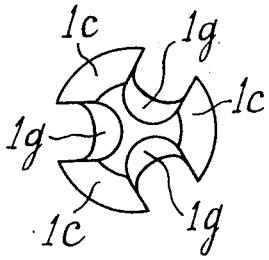
Figure 9:
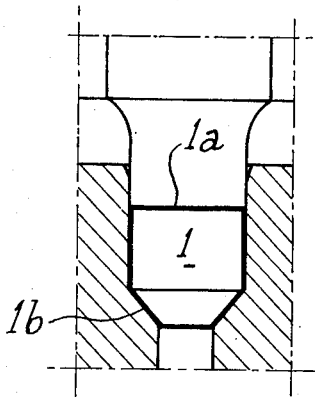
Figure 10:
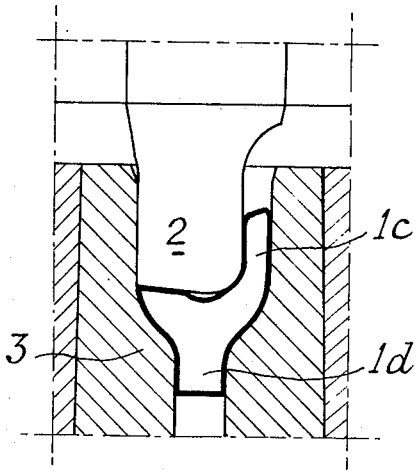
Figure 11:
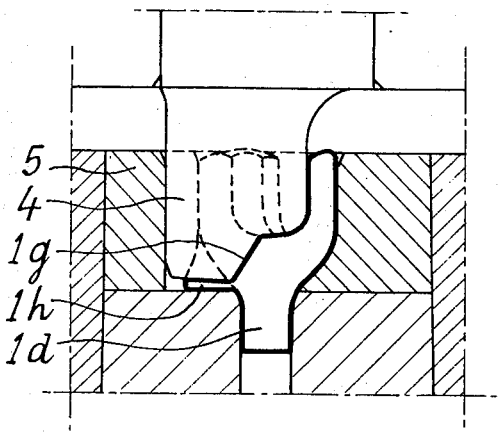
Figure 12:
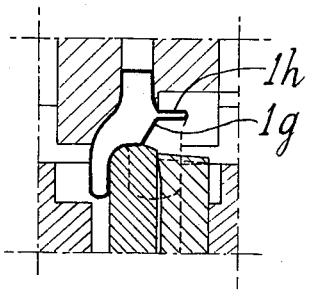
Figure 13:
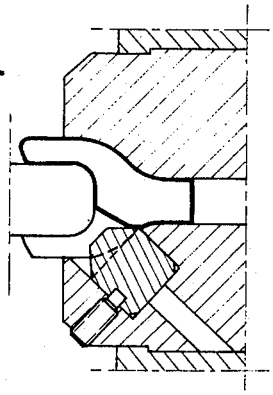

FIG. 5*a* is a view corresponding to FIG. 5 showing a modified part obtained after the third forging operation;

FIG. 6 shows, in axial section, the part obtained after the fourth forging operation;

FIG. 7 shows, in axial section, the final petalled tulip-shaped component obtained;

FIG. 8 is a plan view of FIG. 7;

FIG. 9 shows the first forging operation, in axial section;

FIG. 10 shows the second forging operation, in axial section;

FIG. 11 shows the third forging operation, in axial section;

FIG. 12 shows the fourth forging operation, in axial section;

FIG. 13 shows the fifth forging operation, in axial section.

Figure 1:
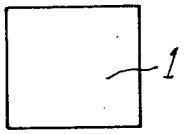
FIG. 1 shows the initial billet.
Figure 2:
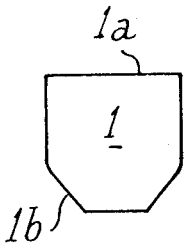
FIG. 2 shows the blank obtained after the first forging operation.
Figure 3:
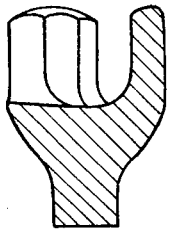
FIG. 3 shows, in axial section, the part obtained after the second forging operation.

The raw material from which the billet 1 (FIG. 1) is to be obtained may be rolled or drawn, the billet 1 being obtained from the raw material by sawing or shearing. The final required shape of the component is one of angularly trifurcated configuration with each prong having the general shape of a petal, especially a tulip petal.

The first forging operation (FIG. 9) consists in gauging the upper side 1*a* of the billet 1 and roughing-out the stem by producing a peripheral chamfer 1*b*.

Figure 4:
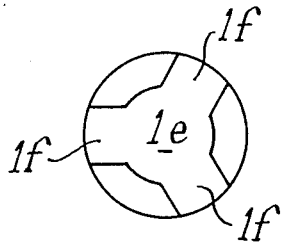
FIG. 4 is a plan view of FIG. 3.

The second forging operation (FIG. 10) consists in reverse drawing roughly to form the petals 1*c* and in direct drawing partly to form the stem 1*d*. The drawing punch 2 is adjusted diametrically in the die 3. Nevertheless, it is necessary to take into account the spreading of the die 3 under load in order to prevent too large a burr from occuring between the punch 2 and die 3. A safety device (not shown) is preferably provided so that the punch 2 cannot be introduced into the die 3 in the absence of a billet 1. As shown in FIG. 4, during this second operation, there is produced in the end face 1*a* of the blank 1, located between the petals 1*c*, a central recess 1*e* extending to the periphery of the partly forged billet 1 in the form of radial recesses 1*f* equiangularly distributed about the billet axis.

The third forging operation (FIG. 11) is carried out on the part as roughed-out in accordance with FIG. 10 and which, in the meantime, has undergone a thermal softening treatment and bonderization (surface treatment - corrosion protection) depending on the raw material used. During this third operation, the base and lower end of the lateral sides of each radial recess 1*f* are pushed back towards the stem 1*d* in order to produce, on the side adjacent the axis of the part 1, a lateral surface or ramp 1*g* which is oblique with respect to said axis and directed away from the latter in the sense from the petals 1*c* to the stem 1*d* of the part 1. This ramp 1*g* defines each radial recess 1*f* adjacent the axis of the part and is extended on the side opposite said axis by a surface constituted by a thin surplus wall 1*h*.

The base of the ramp 1*g* is thus obtained by displacement of the material externally and internally towards the stem 1*a* to determine the length of the latter. This displacement of internal material is necessary to prevent the formation of creases in the central section of the part 1. The punch 4 is appropriately guided in the die 5 and the forging force is slight.

The tools 4, 5 may be unitary in one-piece or preferably interconnected. They comprise the die 5 which has three apertures at 120° and the width of which is greater than the corresponding parts of the punch 4. Since the clearance between the two tools 4, 5 is equal to the thickness of the wall 1*h* obtained, the latter may have the shape illustrated in FIGS. 5 or 5*a* depending on the punch 4 used. According to FIG. 5, the surplus wall 1*h* is constituted by a burr. According to FIG. 5*a*, the wall 1*h* is thicker but has a thin section 1*i* connecting it to the remainder of the part 1.

The fourth operation (FIG. 12) consists of cutting-off the wall or burr 1*h*, vertically striking-off the outer edges of the ramps 1*g* and of obtaining the dimension *a* (FIG. 6) which is definitive for the radial dimension of the ramps 1*g*, by producing a chamfer 1*j* at the junction between said ramps 1*g* and the lower side 1*k* adjacent the stem 1*d* of the part 1. The chamfer 1*j* will then serve to house material at the time of internal gauging of the ramps 1*g* by means of balls.

A fifth forging operation (FIG. 13) consists of laterally perfecting the chamfer 1*j* roughed-out in the forth operation.

A sixth operation is frequently necessary in order to true the petals 1*c* before delivery of the component. This trueing is carried out by drawing the outer diameter.

The ideal press for obtaining this component at low cost is a machine comprising three forging stations.

What is claimed is:

1. A method for the production of a petalled component by cold-forging and comprising the steps of:- a. producing, during a first forging operation, a blank which has dimensions corresponding approximately to those of the petalled component to be obtained and which has a peripheral chamfer from which will be produced a stem;

b. roughing out, during a second forging operation, petals and the stem by reverse and direct drawing respectively, and producing in the end face of the blank a recess centrally of the petals and extending by radial recesses to the periphery of said end face;

c. pushing, during a third forging operation, the base and lower end of the lateral faces of each radial recess in the direction of the stem to produce a lateral surface or ramp at the side adjacent the axis of the component, which is oblique with respect to said axis, and defines each radial recess of said component and is extended on the opposite side to said axis, by a surface constituted by a surplus wall, and d. cutting of, during a fourth forging operation, said surplus wall.

2. A method according to claim 1, comprising continuing, during the third forging operation, the shaping of the stem of the petalled component by direct drawing.

3. A method according to claim 1, comprising producing during a fifth forging operation, a chamfer at the junction between the oblique ramps and the lower side adjacent the stem of the petalled component.

4. A method according to claim 1, in which the surplus walls are constituted by burrs.

5. A petalled compound produced by the method of claim 1.

* * * * *